United States Patent [19]

Largen

[11] Patent Number: 4,528,827

[45] Date of Patent: Jul. 16, 1985

[54] EXTRACTOR DRUM BALANCER

[76] Inventor: Elbert M. Largen, Rte. 1, Box 14A, Laurel Fork, Va. 24392

[21] Appl. No.: 570,239

[22] Filed: Jan. 12, 1984

Related U.S. Application Data

[63] Continuation-in-part of Ser. No. 307,103, Sep. 30, 1981, abandoned.

[51] Int. Cl.[3] ..... D06F 37/24

[52] U.S. Cl. ..... 68/23.2; 210/144

[58] Field of Search ..... 68/23.2, 23.3; 210/144, 210/363, 364; 74/573 F; 494/82

[56] References Cited

FOREIGN PATENT DOCUMENTS 841584 6/1952 Fed. Rep. of Germany ..... 68/23.2

*Primary Examiner*—Philip R. Coe

*Attorney, Agent, or Firm*—Harvey B. Jacobson; Clarence A. O'Brien

[57] ABSTRACT

A drum defining a center axis is journalled from a support for rotation about its center axis through the utilization of resilient means permitting the axis and drum to gyrate about a center position of the axis responsive to dynamic imbalance of the drum during rotation thereof. The drum includes a plurality of circumferentially spaced liquid-passing openings and a plurality of liquid receptacles are mounted from the drum for receiving liquid therein from the openings. The receptacles are mounted from the drum for shifting between liquid retaining positions and liquid dumping positions and stationary receptacle position shifting structure is mounted from the support and the receptacles are mounted on the drum for normal disposition in either the liquid receiving positions or the liquid dumping positions. The receptacles include structure engageable with the receptacle position shifting structure operative to shift the receptacles from one position thereof to the other position thereof responsive to gyration of the center axis about said center position. The liquid receiving receptacles function to retain liquid passing through the openings on the lighter side of the drum or to dump liquids therefrom on the heavier side of the drum and in this manner the dynamic imbalance of the drum may be substantially eliminated.

10 Claims, 6 Drawing Figures

EXTRACTOR DRUM BALANCER

REFERENCE TO RELATED APPLICATIONS

This application comprises a continuation-in-part of my co-pending application Ser. No. 307,103, for HYDROSTATIC EXTRACTOR BALANCER, filed Sept. 30, 1981, now abandoned.

BACKGROUND OF THE INVENTION

Centrifugal extractors such as those used in washing machines to spin dry a load of clothes having been washed and rinsed incorporate upwardly opening tubs into which clothes to be washed may be placed and the tubs are mounted for rotation about the center axes of the tubs by journal structure including resilient components enabling the center axes and the tubs to gyrate about center positions of those axes responsive to dynamic imbalance of the tubs. Washing machine spin dry tubs of this type are capable of operating effectively and without damage thereto under slight to medium dynamic imbalance conditions, but the dynamic imbalance of such tubs can be excessive when larger items such as sheets and bedspreads are being washed.

Excessive dynamic imbalance of washing machine tubs causes the outer peripheral portions of the tubs to strike stationary components of the washing machine during rotation of the tubs at spin-drying speeds and contact between the tubs and stationary washing machine components not only causes damage to those components engaging each other, but may also cause the entire washing machine to "walk" over the floor and water connections between stationary water supply pipes and the washing machine to be broken.

Accordingly, a need exists for structure by which dynamic imbalance of a rotating washing machine spin-drying tub or similar structure may be effectively reduced.

Various different forms of rotating drum or tub balancing structures including some of the general structural and operational features of the instant invention are disclosed in U.S. Pat. Nos. 2,463,801, 2,538,246, 2,886,979, 3,060,713 and 3,066,522 as well as Great Britain Pat. No. 663,829 and German Pat. No. 1,214,613.

BRIEF DESCRIPTION OF THE INVENTION

The extractor balancer of the instant invention incorporates a plurality of receptacles or buckets spaced about and pivotally supported from the liquid-passage opening equipped upper periphery of a washing machine drum or the like and the receptacles or buckets are disposed in position to receive water being discharged through the openings. In a first form of the invention the buckets are supported for normal disposition in the water retaining positions and in a second form of the invention the buckets are supported for normal disposition in the water dumping positions thereof. The drum is journalled from a stationary support structure of the associated washing machine and the washing machine support structure mounts stationary receptacle position shifting structure therefrom engageable by the receptacles responsive to gyration of the axis of rotation of the drum about the center position thereof. In the first form of the invention the receptacles on the heavier side of the drum are shifted to the water dumping positions and in the second form of the invention the receptacles on the lighter side of the drum are shifted from the water dumping positions to the water retaining positions.

The main object of this invention is to provide an extractor drum with structure which will automatically reduce the dynamic imbalance of the drum as liquid from within the drum is spun through the liquid passage openings thereof.

Another object of this invention is to provide an extractor drum balancing structure which may be readily incorporated in the manufacture of new drums.

Still another object of this invention is to provide an extractor drum balancer whose operation is dependent solely upon rotation of the associated drum and dynamic imbalance thereof.

A final object of this invention to be specifically enumerated herein is to provide an extractor drum balancer in accordance with the preceding objects and which will conform to conventional forms of manufacture, be of simple construction and automatic in operation so as to provide a device that will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
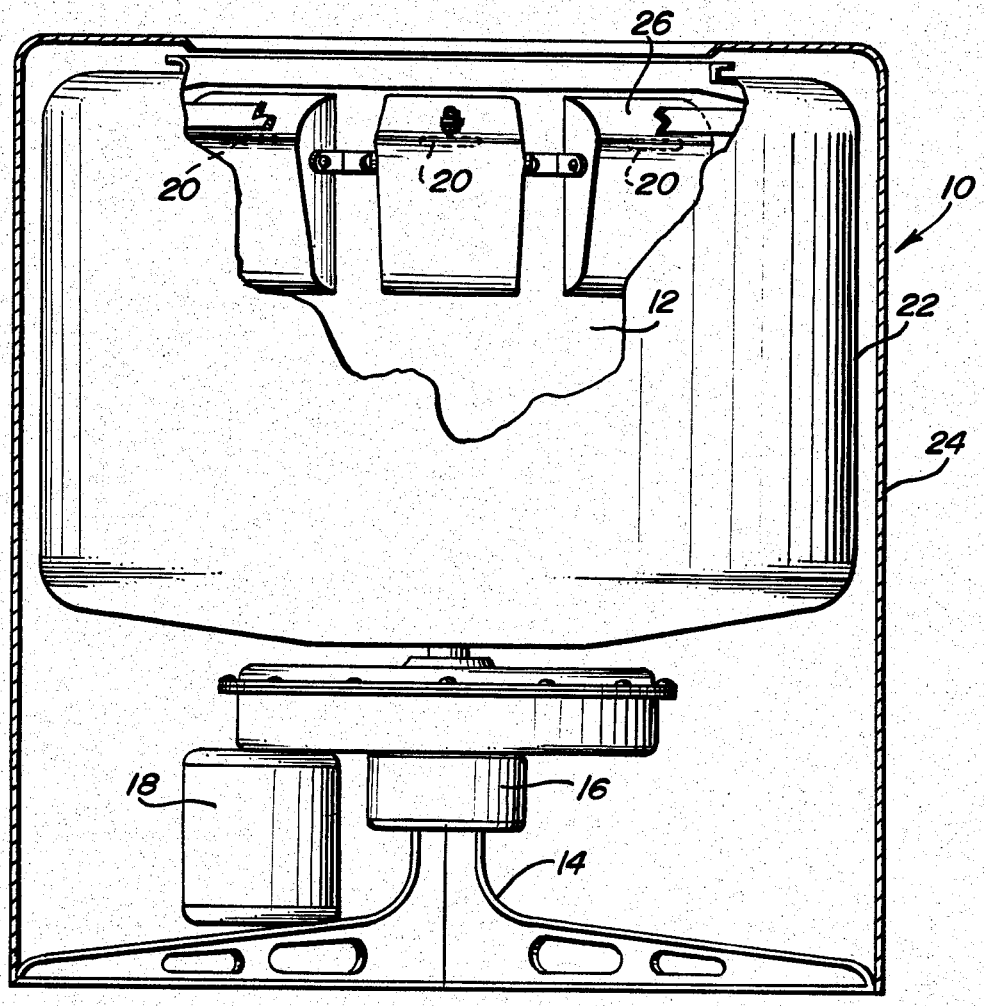
FIG. 1 is a fragmentary vertical sectional view of an extractor drum of the type used in a washing machine and incorporating the extractor drum balancer structure of the instant invention.
Figure 2:
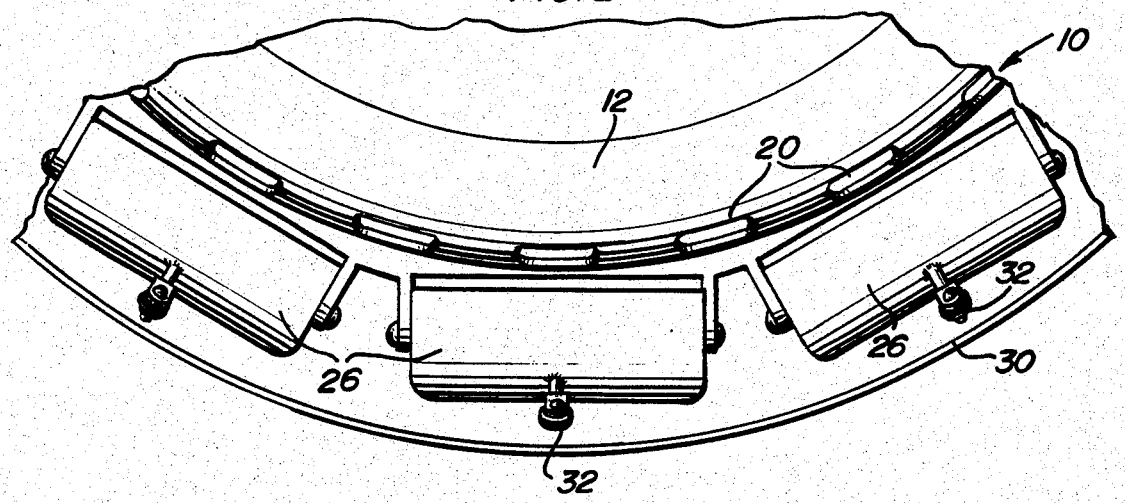
FIG. 2 is a fragmentary enlarged top plan view of the near side portion of the extractor drum illustrated in FIG. 1.

Referring now more specifically to FIGS. 1 and 2 of the drawings there may be seen a conventional form of washing machine (schematically illustrated) referred to in general by the reference numeral 10 and including an upright drum 12 journalled for rotation about an upstanding axis. The drum 12 is journalled from a stationary support structure 14 by resilient means 16 and driven by an electric motor 18. The upper portion of the drum 12 includes water passage openings 20 formed therein at points spaced circumferentially thereabout and the drum 12 is enclosed within a stationarily supported water catching drum 22. Further, a housing 24 stationary with the drum 22 is disposed about and encloses the drum 22 as well as the support structure 14 and in order to spin water from clothes having been washed and rinsed within the drum 12 the drum 12 is rotated at high speed by the motor 18 within the drum 22. As the drum 12 rotates at high speed, water is extracted from the clothes therein by centrifugal force and discharged through the openings 20 into the drum 22 from which the water is subsequently pumped.

The foregoing may be considered as descriptive of conventional washing machine structure and also as descriptive of conventional liquid extracting structures used in different environments.

When the drum 12 is substantially evenly loaded during its rotation to spin water therefrom, the drum 12 will rotate about a substantially stationary axis. However, should the drum 12 be unevenly loaded so as to be dynamically out of balance, rotation of the drum 12 at high water extracting speeds will cause the axis of rotation of the drum 12 defined by the resilient means 16 to gyrate about the center position of the axis with the result that the drum 12 may strike opposing inner surfaces of the drum 22.

Figure 3:
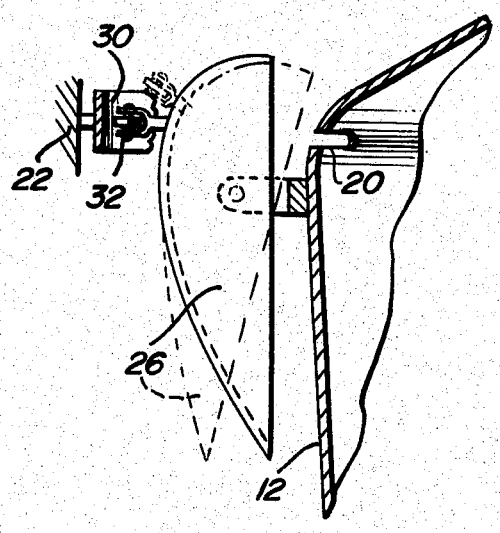
FIG. 3 is a fragmentary enlarged vertical sectional view taken substantially upon a plan passing through one of the balancing receptacles and illustrating the manner in which the balancing receptacle may be pivoted from a water retaining position toward a water dumping position responsive to the water receptacle being disposed on the heavy side of the drum.

In order to compensate for dynamic imbalance of the drum 12 during high speed rotation thereof, the exterior of the drum 12 has inwardly opening water receiving receptacles or buckets 26 pivotally supported therefrom in registry with the openings 20. The receptacles or buckets are mounted for oscillation between water retaining positions and water dumping positions about horizontal axes disposed at right angles relative to intersecting radii of the drum 12. The receptacles 26 are weighted to assume the solid line water catching and retaining positions thereof illustrated in solid lines in FIG. 3 during high speed rotation of the drum 12 whereby water equal in volume to the interior of the receptacles or buckets 26 discharged thereinto from the openings 20 will be retained within the receptacles or buckets 26. However, the interior of the drum 22 mounts a stationary ring 30 co-axial with the center position of the axis of rotation of the drum 12 and each of the receptacles or buckets 26 includes a wheel 32 journalled therefrom rollingly engageable with the ring 30 as the upper end of the drum 12 gyrates about the center position of its axis of rotation. Accordingly, the water retained in the receptacles or buckets 26 on the heavier side of the drum 12 will be dumped therefrom by engagement of the corresponding rollers 32 with the ring 30 and movement of the receptacles or buckets 26 from the solid line position of FIG. 3 to the phantom line position thereof. This will of course lighten the heavier side of the drum 12 and thus improve its dynamic balance.

Figure 4:
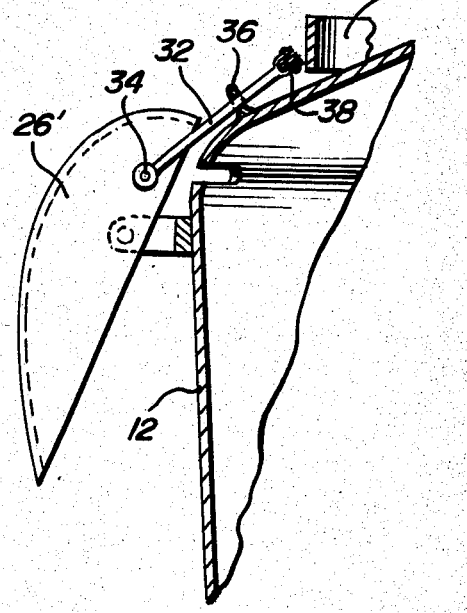
FIG. 4 is a fragmentary vertical sectional view similar to FIG. 3 but illustrating a modified form of the invention wherein the water receiving receptacle is normally disposed in a water dumping position and is pivoted to a water retaining position when the water receptacle is disposed on the lighter side of the associated drum.

With attention now invited more specifically to FIG. 4 of the drawings, there may be seen a modified form of the instant invention wherein buckets or receptacles 26' corresponding to the buckets or receptacles 26 are oscillatably supported from the drum 12 in water dumping positions and each of the buckets 26' has one end of an elongated motion transmitting rod 32 pivotally supported therefrom as at 34. Each of the rods 32 is received through a corresponding guide 36 supported from the drum 12 and the end of each rod 32 remote from the associated receptacle or bucket 26' has a roller 38 journalled therefrom rollingly engageable with the outer side of a stationary ring 30' corresponding to the ring 30.

In that form of the invention illustrated in FIG. 4 the buckets or receptacles 26 are weighted so as to normally assume a water dumping position. However, should the axis of rotation of the drum 12 gyrate about the center position thereof during high speed rotation of the drum 12 due to dynamic imbalance of the drum 12, those receptacles or buckets 26 disposed on the lighter side of the drum will have the associated rollers 38 contacting the ring 30' in order to pivot the receptacles or buckets 26' on the lighter side of the drum 12 back to the water retaining positions thereof. In this manner, weight is added to the lighter side of the drum 12 in order to improve upon the dynamic balancing thereof.

Figure 5:
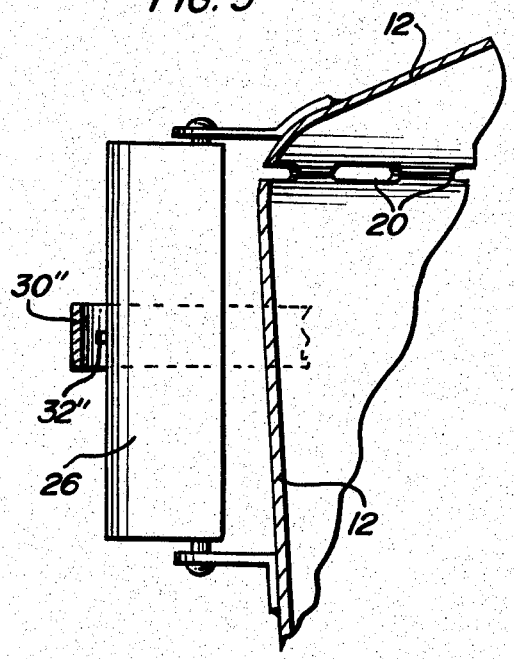
FIG. 5 is a fragmentary vertical sectional view similar to FIG. 3 but illustrating a second modified form of the invention wherein the water receiving receptacles are mounted for oscillation about vertical axes.
Figure 6:
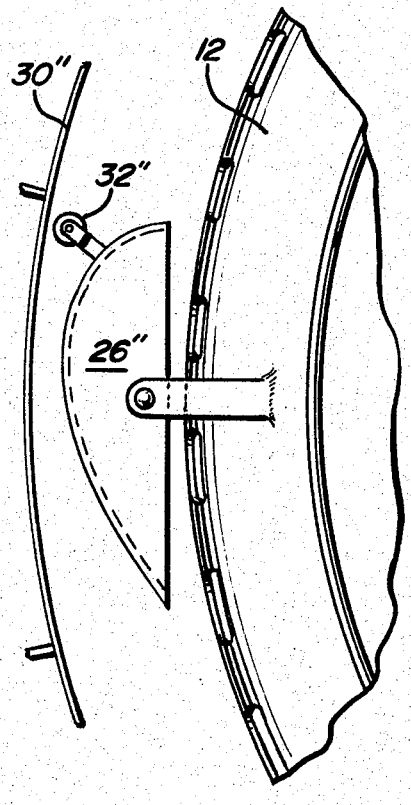
FIG. 6 is a fragmentary top plan view of the assemblage illustrated in FIG. 5.

With attention now invited more specifically to FIGS. 5 and 6 of the drawings, there may be seen still another modified form of the invention wherein the receptacles or buckets 26'' are oscillatably supported from the drum 12 for angular displacement about vertical axes. The receptacles 26'' are weighted so as to normally assume a water retaining position and the receptacles 26'' include rollers 32'' corresponding to the rollers 32 and engageable with a ring 30'' corresponding to the ring 30 on the heavier side of the drum 12 whereby water caught in the receptacles or buckets 26'' on the heavier side of the drum 12 will be dumped therefrom. Thus, each of the three disclosed forms of the invention is operative to decrease the dynamic imbalance of the corresponding drum as the latter is rotated at sufficient speed to spin water from the interior of the drum by centrifugal force.

It is to be noted that although the instant invention has been illustrated and described herein as operatively associated with a vertical axis drum of a washing machine, the balancing structure of the instant invention may well be used in conjunction with other types of spinning drums.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a support, a drum defining a center axis and resilient means journalling the drum from said support for rotation about said axis and permitting said axis and drum to gyrate about a center position of said axis responsive to dynamic imbalance of said drum during rotation thereof, said drum including a plurality of circumferentially spaced liquid-passing openings formed therethrough, a plurality of liquid receptacles mounted from said drum for receiving liquid therein from said openings, said receptacles being mounted for shifting between liquid retaining positions and liquid dumping positions, stationary receptacle position shifting means mounted from said support, said receptacles being mounted from said drum for normal disposition in one of said positions, said receptacles including means engageable with said receptacle position shifting means operative to shift said receptacles from said one position to the other position responsive to gyration of said center axis about said center position.

2. The combination of claim 1 wherein said receptacles are mounted for normal disposition in said liquid retaining positions.

3. The combination of claim 1 wherein said receptacles are mounted for normal disposition in said liquid dumping positions.

4. The combination of claim 1 wherein said stationary receptacle position shifting means includes a stationarily mounted ring concentric with said center position of said axis, said receptacles supporting motion transmitting means therefrom engageable with said ring upon gyration of said axis and drum about said center position of said axis.

5. The combination of claim 4 wherein said receptacles are mounted for normal disposition in said liquid retaining positions.

6. The combination of claim 4 wherein said receptacles are mounted for normal disposition in said liquid dumping positions.

7. The combination of claim 1 wherein said drum comprises the wash drum of a washing machine.

8. The combination of claim 1 wherein said receptacle and drum include means pivotally mounting said receptacle from said drum for shifting between said liquid retaining and liquid dumping positions.

9. The combination of claim 8 wherein said mounting means pivotally mounts said receptacles from said drum for angular displacement about axes generally paralleling said center axis for shifting between said liquid retaining and liquid dumping positions.

10. The combination of claim 8 wherein said mounting means pivotally mounts said receptacles from said drum for angular displacement about axes disposed at generally right angles relative to said center axis for shifting between said liquid retaining and liquid dumping positions.

* * * * *